US011757235B2

(12) United States Patent
Liu et al.

(10) Patent No.: US 11,757,235 B2
(45) Date of Patent: Sep. 12, 2023

(54) ELECTRICAL CONNECTOR

(71) Applicant: Dongguan Luxshare Technologies Co., Ltd, Dongguan (CN)

(72) Inventors: XiaoGang Liu, Dongguan (CN); ChenHui Zeng, Dongguan (CN); RongZhe Guo, Dongguan (CN); Ming Li, Dongguan (CN)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 263 days.

(21) Appl. No.: 17/395,693

(22) Filed: Aug. 6, 2021

(65) Prior Publication Data

US 2022/0077636 A1 Mar. 10, 2022

(30) Foreign Application Priority Data

Sep. 4, 2020 (CN) ..... 202021913667.8

(51) Int. Cl.

*H01R 13/648* (2006.01)
*H01R 13/6587* (2011.01)
*H01R 13/514* (2006.01)
*H01R 13/6597* (2011.01)

(52) U.S. Cl.

CPC ..... *H01R 13/6587* (2013.01); *H01R 13/514* (2013.01); *H01R 13/6597* (2013.01)

(58) Field of Classification Search

CPC ..... H01R 13/6585; H01R 13/6586; H01R 13/6587; H01R 13/514; H01R 13/516; H01R 13/518; H01R 13/6591; H01R 13/6597

USPC ..... 439/607.05, 607.06, 607.07

See application file for complete search history.

(56) References Cited

U.S. PATENT DOCUMENTS 8,864,521 B2 * 10/2014 Atkinson ..... H01R 13/504 439/607.07
8,888,530 B2 * 11/2014 Trout ..... H01R 13/6587 439/607.07
8,998,642 B2 * 4/2015 Manter ..... H01R 13/518 439/607.07

(Continued)

*Primary Examiner* — Khiem M Nguyen
(74) *Attorney, Agent, or Firm* — Birch, Stewart, Kolasch & Birch, LLP

(57) ABSTRACT

An electrical connector, comprising an insulating housing, a housing electromagnetic shielding member, and a plurality of terminal modules. The insulating housing comprises a first surface, a second surface, a plurality of terminal plugging hole groups, and a plurality of shield accommodating grooves. The first surface is opposite to the second surface. The plurality of terminal plugging hole groups are arranged at intervals. Each of the terminal plugging hole groups comprises a plurality of ground terminal plugging holes and a plurality of signal terminal plugging holes penetrating the first surface and the second surface. Each of the shield accommodating grooves is formed on the second surface and is disposed on one side of the corresponding terminal plugging hole group. The housing electromagnetic shielding member is embedded on the second surface and comprises a plurality of connecting bumps. Each of the terminal modules comprises a terminal electromagnetic shielding member.

20 Claims, 16 Drawing Sheets

(56) References Cited

U.S. PATENT DOCUMENTS

| | | | | |
|---|---|---|---|---|
| 9,022,806 | B2 * | 5/2015 | Cartier, Jr. ..... | H01R 13/6587<br>439/607.07 |
| 11,626,695 | B2 * | 4/2023 | Westman ..... | H01R 13/6585<br>439/607.07 |
| 2023/0148426 | A1 * | 5/2023 | He ..... | H01R 13/6477<br>439/607.07 |

* cited by examiner

ELECTRICAL CONNECTOR

CROSS-REFERENCE TO RELATED APPLICATION

This application claims the priority benefit of Chinese Patent Application Serial Number 202021913667.8, filed on Sep. 4, 2020, the full disclosure of which is incorporated herein by reference.

BACKGROUND

Technical Field

The present disclosure relates to the technical field of connector, particularly to an electrical connector.

Related Art

Nowadays, the requirements of the transmission efficiency and performance of conventional connectors have been greatly improved. Although the connectors need to have high transmission efficiency and great transmission performance, crosstalking often occurs among the plurality of signal terminals of the connector during the signal transmission process. Since conventional connectors are equipped with electromagnetic shielding members, the electromagnetic shielding part cannot be effectively connected with the electromagnetic shielding member of the terminal module of the connector due to the assembly process. Thus, it would cause crosstalk among the plurality of signal terminals in the signal transmission process.

SUMMARY

The embodiments of the present disclosure provide an electrical connector tended to solve the problem that the electromagnetic shielding member mounted to the connector cannot effectively contact with the electromagnetic shielding member of the terminal module of the connector.

The present disclosure provides an electrical connector, comprising an insulating housing, a housing electromagnetic shielding member, and a plurality of terminal modules. The insulating housing comprises a first surface, a second surface, a plurality of terminal plugging hole groups, and a plurality of shield accommodating grooves. The first surface is opposite to the second surface. The plurality of terminal plugging hole groups are arranged at intervals. Each of the terminal plugging hole groups comprises a plurality of ground terminal plugging holes and a plurality of signal terminal plugging holes penetrating the first surface and the second surface. Each of the shield accommodating grooves is formed on the second surface and is disposed on one side of the corresponding terminal plugging hole group. The housing electromagnetic shielding member is embedded on the second surface and comprises a plurality of connecting bumps. Each of the connecting bumps is disposed in the ground terminal plugging hole and at one side of the corresponding shield accommodating groove. The plurality of terminal modules are disposed on the first surface. Each of the terminal modules comprises a plurality of ground terminals, a plurality of signal terminals, and a terminal electromagnetic shielding member. The plurality of ground terminals are disposed in the plurality of ground terminal plugging holes of the corresponding terminal plugging hole group. The plurality of signal terminals are disposed in the plurality of signal terminal plugging holes of the corresponding terminal plugging hole group. The terminal electromagnetic shielding member is disposed in the corresponding shield accommodating groove and connected with the corresponding plurality of connecting bumps.

In the embodiments of the present disclosure, by embedding the housing electromagnetic shielding member in the insulating housing, the housing electromagnetic shielding member and the insulating housing can be integrated. In this way, when the terminal module is assembled to the insulating housing, the terminal electromagnetic shielding member of the terminal module can be accurately connected to the housing electromagnetic shielding member, so that the terminal electromagnetic shielding member can be effectively connected to the housing electromagnetic shielding member to ensure that the housing electromagnetic shielding member could perform electromagnetic shielding, thereby improving the signal transmission performance of the electrical connector.

It should be understood, however, that this summary may not contain all aspects and embodiments of the present disclosure, that this summary is not meant to be limiting or restrictive in any manner, and that the disclosure as disclosed herein will be understood by one of ordinary skill in the art to encompass obvious improvements and modifications thereto.

BRIEF DESCRIPTION OF THE DRAWINGS

The features of the exemplary embodiments believed to be novel and the elements and/or the steps characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION OF THE EMBODIMENTS

The present disclosure will now be described more fully hereinafter with reference to the accompanying drawings, in which exemplary embodiments of the disclosure are shown. This present disclosure may, however, be embodied in many different forms and should not be construed as limited to the embodiments set forth herein. Rather, these embodiments are provided so that this present disclosure will be thorough and complete, and will fully convey the scope of the present disclosure to those skilled in the art.

Certain terms are used throughout the description and following claims to refer to particular components. As one skilled in the art will appreciate, manufacturers may refer to a component by different names. This document does not intend to distinguish between components that differ in name but function. In the following description and in the claims, the terms "include/including" and "comprise/comprising" are used in an open-ended fashion, and thus should be interpreted as "including but not limited to". "Substantial/substantially" means, within an acceptable error range, the person skilled in the art may solve the technical problem in a certain error range to achieve the basic technical effect.

The following description is of the best-contemplated mode of carrying out the disclosure. This description is made for the purpose of illustration of the general principles of the disclosure and should not be taken in a limiting sense. The scope of the disclosure is best determined by reference to the appended claims.

Moreover, the terms "include", "contain", and any variation thereof are intended to cover a non-exclusive inclusion. Therefore, a process, method, object, or device that includes a series of elements not only includes these elements, but also includes other elements not specified expressly, or may include inherent elements of the process, method, object, or device. If no more limitations are made, an element limited by "include a/an . . . " does not exclude other same elements existing in the process, the method, the article, or the device which includes the element.

Figure 1:
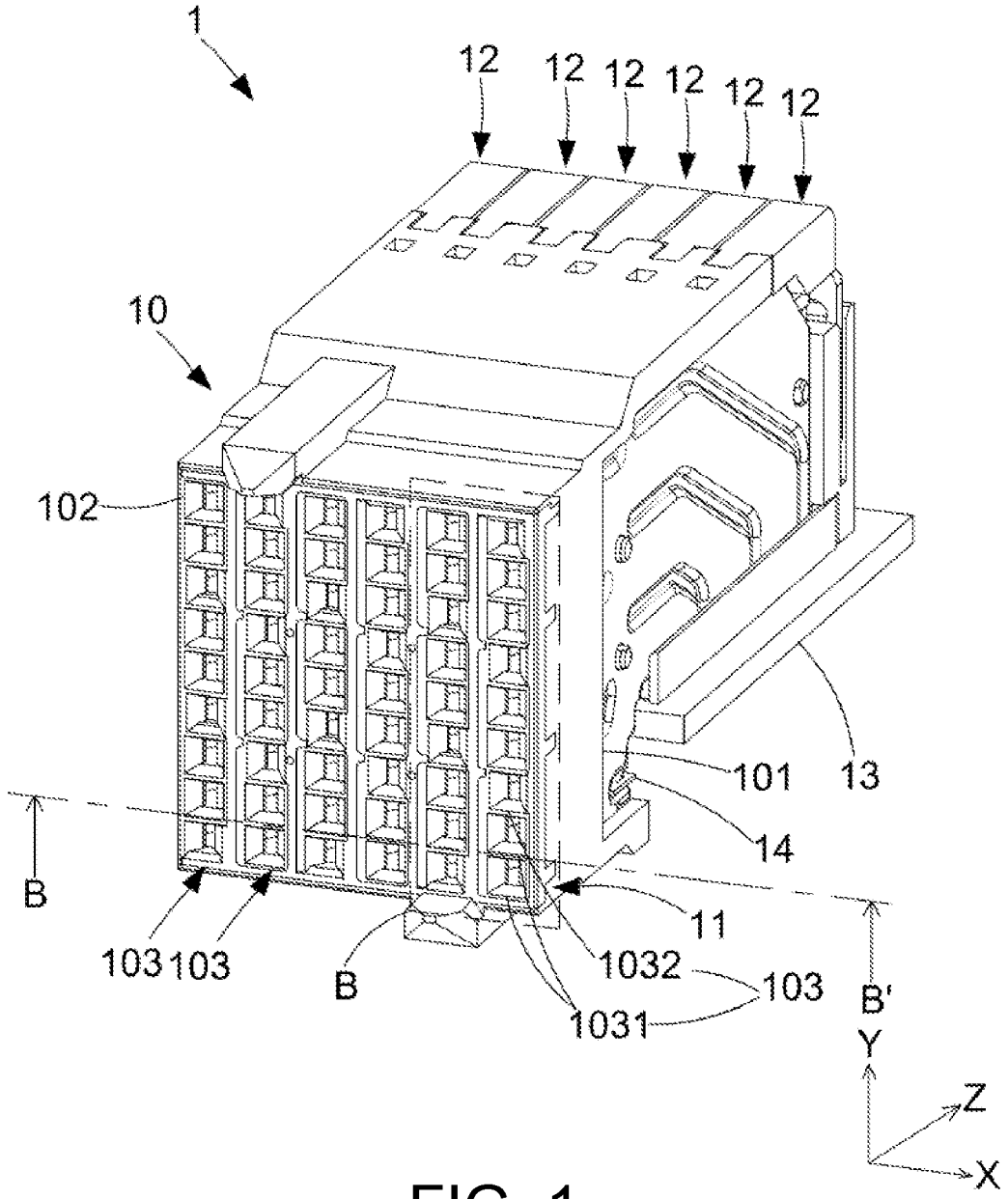
FIG. 1 is a perspective view of an electrical connector of an embodiment of the present disclosure.
Figure 2:
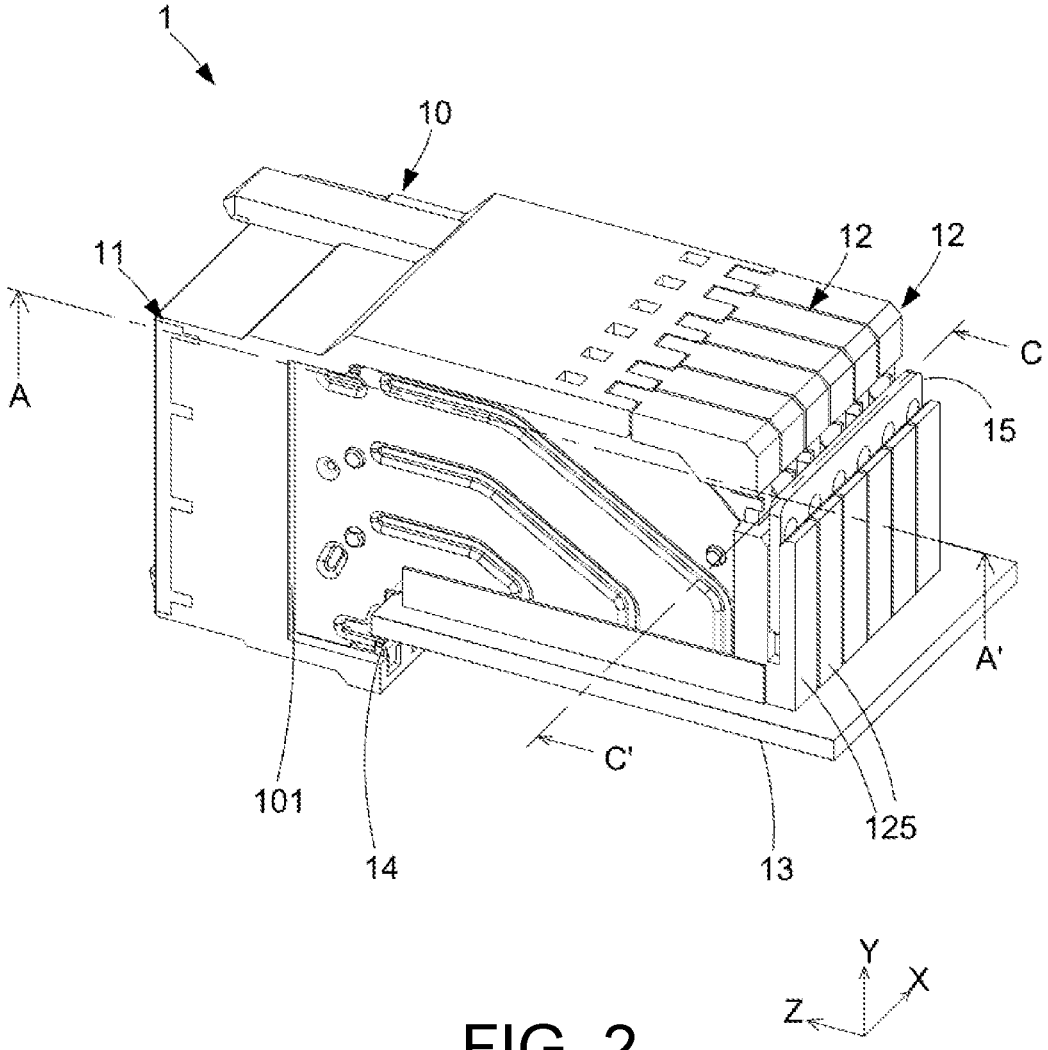
FIG. 2 is another perspective view of the electrical connector of an embodiment of the present disclosure.
Figure 3:
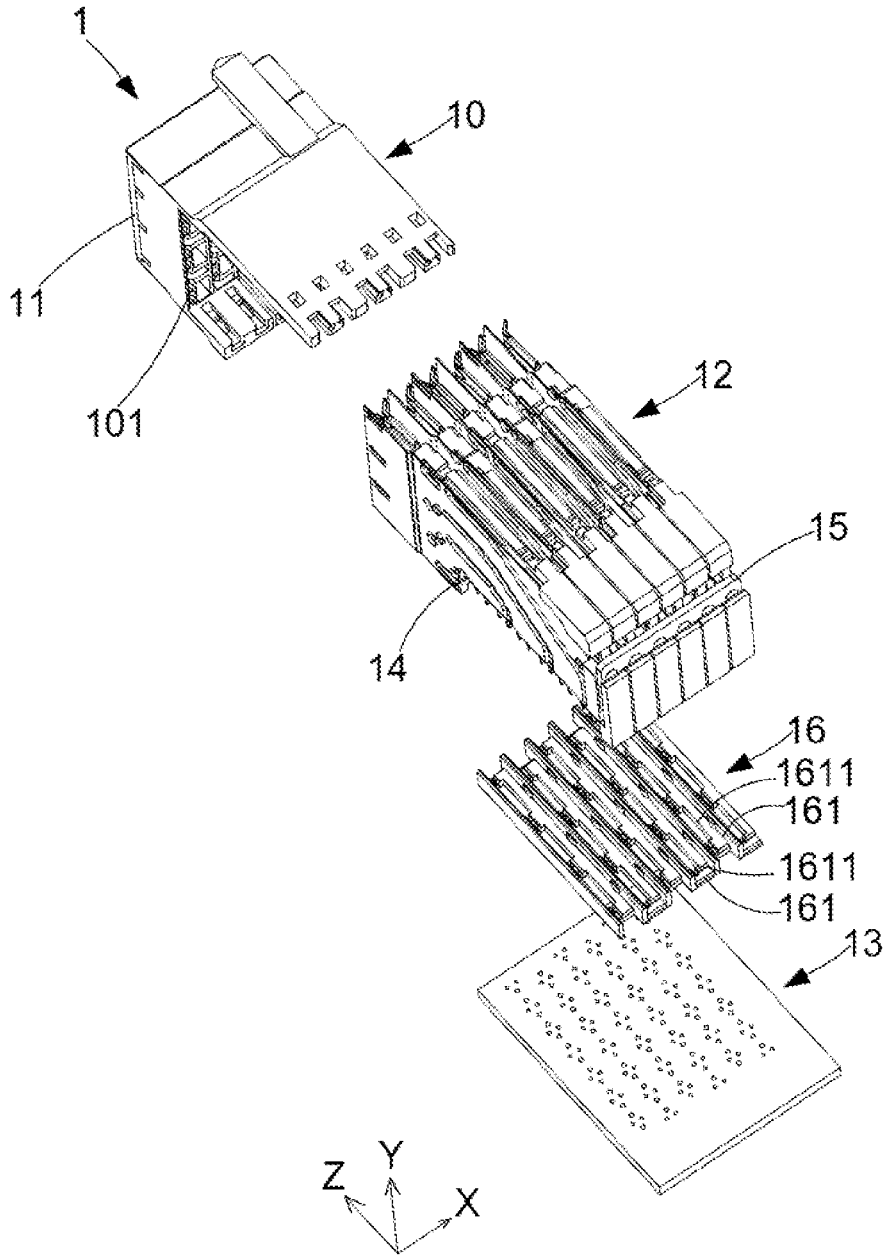
FIG. 3 is an exploded view of an electrical connector of an embodiment of the present disclosure.
Figure 4:
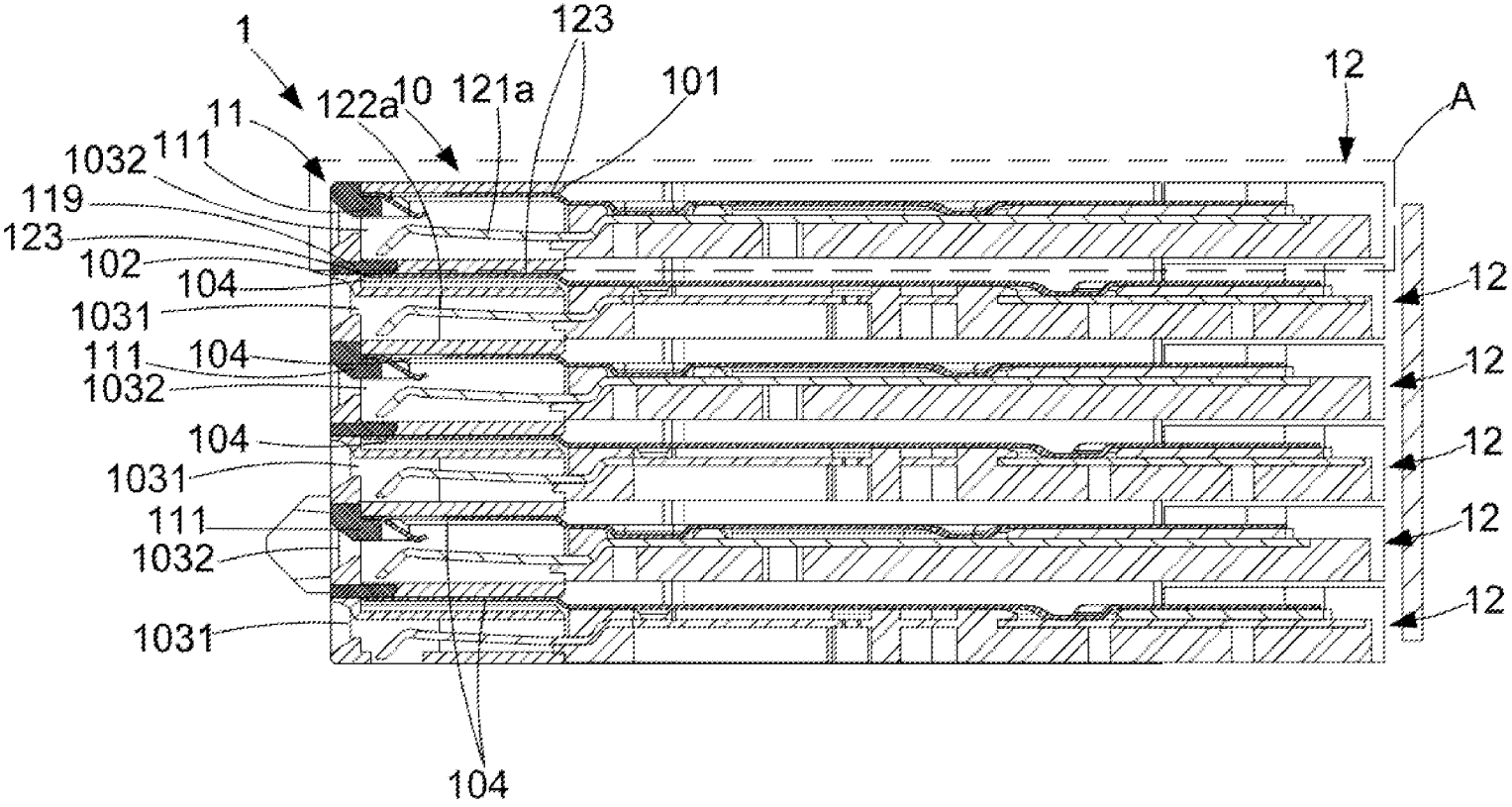
FIG. 4 is a cross-sectional view along line A-A' in FIG. 2.

FIG. 1 to FIG. 3 are perspective views and exploded view of an electrical connector of an embodiment of the present disclosure. FIG. 4 is a cross-sectional view along line A-A' in FIG. 2. As shown in the figures, in this embodiment, the electrical connector 1 comprises an insulating housing 10, a housing electromagnetic shielding member 11, a plurality of terminal modules 12, and a circuit board 13. The insulating housing 10 comprises a first surface 101, a second surface 102, a plurality of terminal plugging hole groups 103, and a plurality of shield accommodating grooves 104. The first surface 101 is opposite to the second surface 102. The plurality of terminal plugging hole groups 103 are disposed along a first direction X at intervals. Each of the terminal plugging hole groups 103 comprises a plurality of signal terminal plugging holes 1031 penetrating the first surface 101 and a plurality of ground terminal plugging holes 1032 penetrating the second surface 102. The plurality of signal terminal plugging holes 1031 and the plurality of ground terminal plugging holes 1032 are arranged along a second direction Y at intervals. In this embodiment, two signal terminal plugging holes 1031 are provided between two adjacent ground terminal plugging holes 1032 of each of the terminal plugging hole groups 103. Each of the ground terminal plugging holes 1032 of each of the terminal plugging hole groups 103 corresponds to the signal terminal plugging hole 1031 of adjacent terminal plugging hole group 103. Each of the shield accommodating grooves 104 is formed on the first surface 101 and is disposed on one side of the corresponding terminal plugging hole group 103. That is, the terminal plugging hole group is provided between two adjacent shield accommodating grooves 104. Each of the shield accommodating grooves 104 also extends along the second direction Y and is in communication with the plurality of ground terminal plugging holes 1032 of the corresponding terminal plugging hole group 103.

Figure 5:
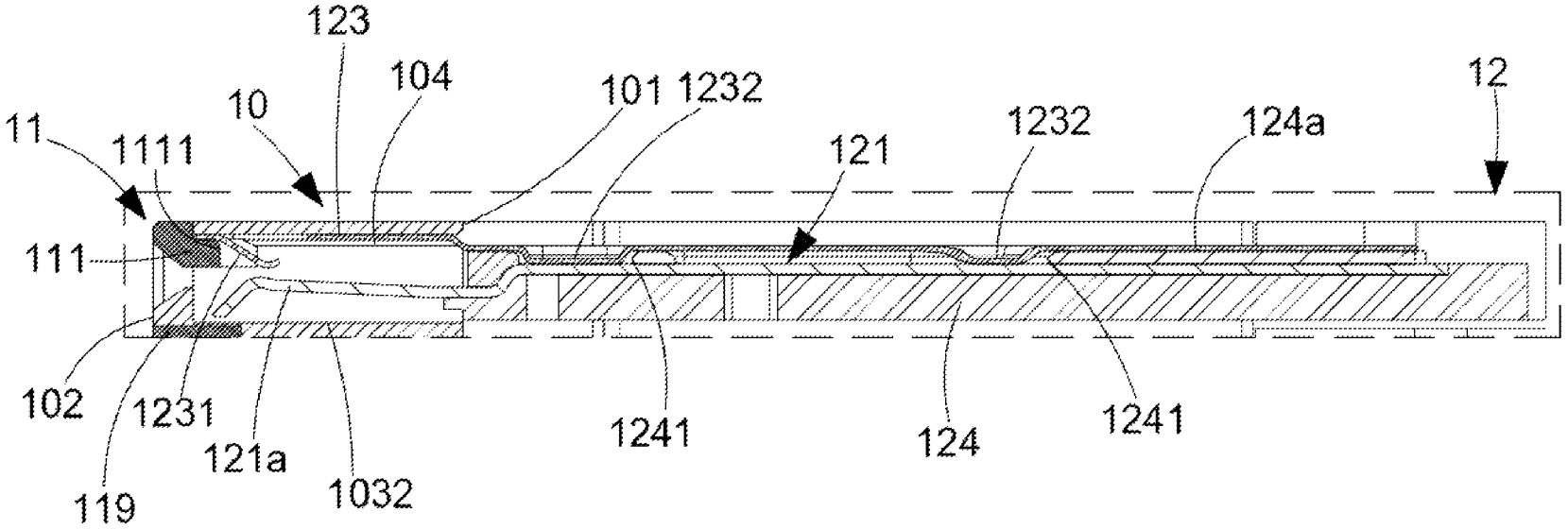
FIG. 5 is an enlarged view of area A of FIG. 4.

FIG. 5 is an enlarged view of area A of FIG. 4. As shown in the figure, the housing electromagnetic shielding member 11 is embedded in the second surface 102 of the insulating housing 10 and is exposed from the second surface 102. The housing electromagnetic shielding member 11 comprises a plurality of connecting bumps 111, which are respectively disposed in the corresponding ground terminal plugging holes 1032, and are disposed at one side of the corresponding shield accommodating groove 104. In this embodiment, the insulating housing 10 is formed on the housing electromagnetic shielding member 11 by injection molding, so housing electromagnetic shielding member 11 cannot be arbitrarily removed from the insulating housing 10, which indicates that the housing electromagnetic shielding member 11 is integrated with the insulating housing 10.

Figure 6:
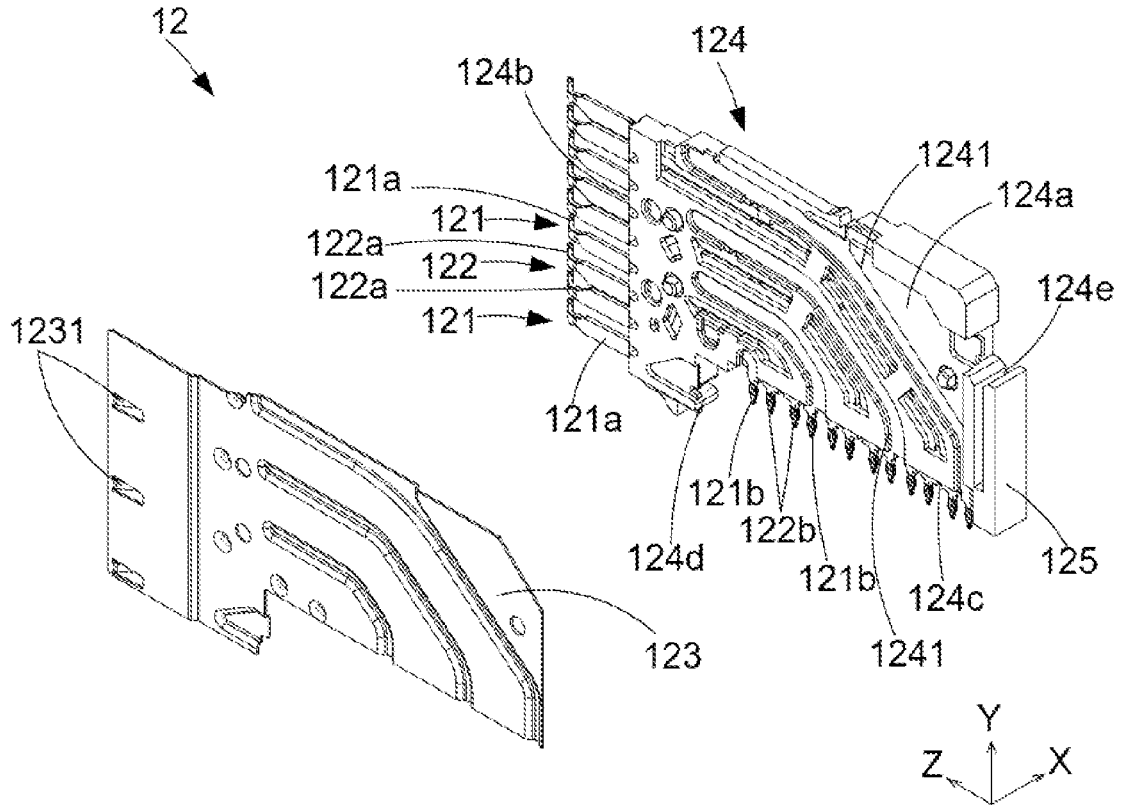
FIG. 6 is an exploded view of a terminal module of the first embodiment of the present disclosure.
Figure 7:
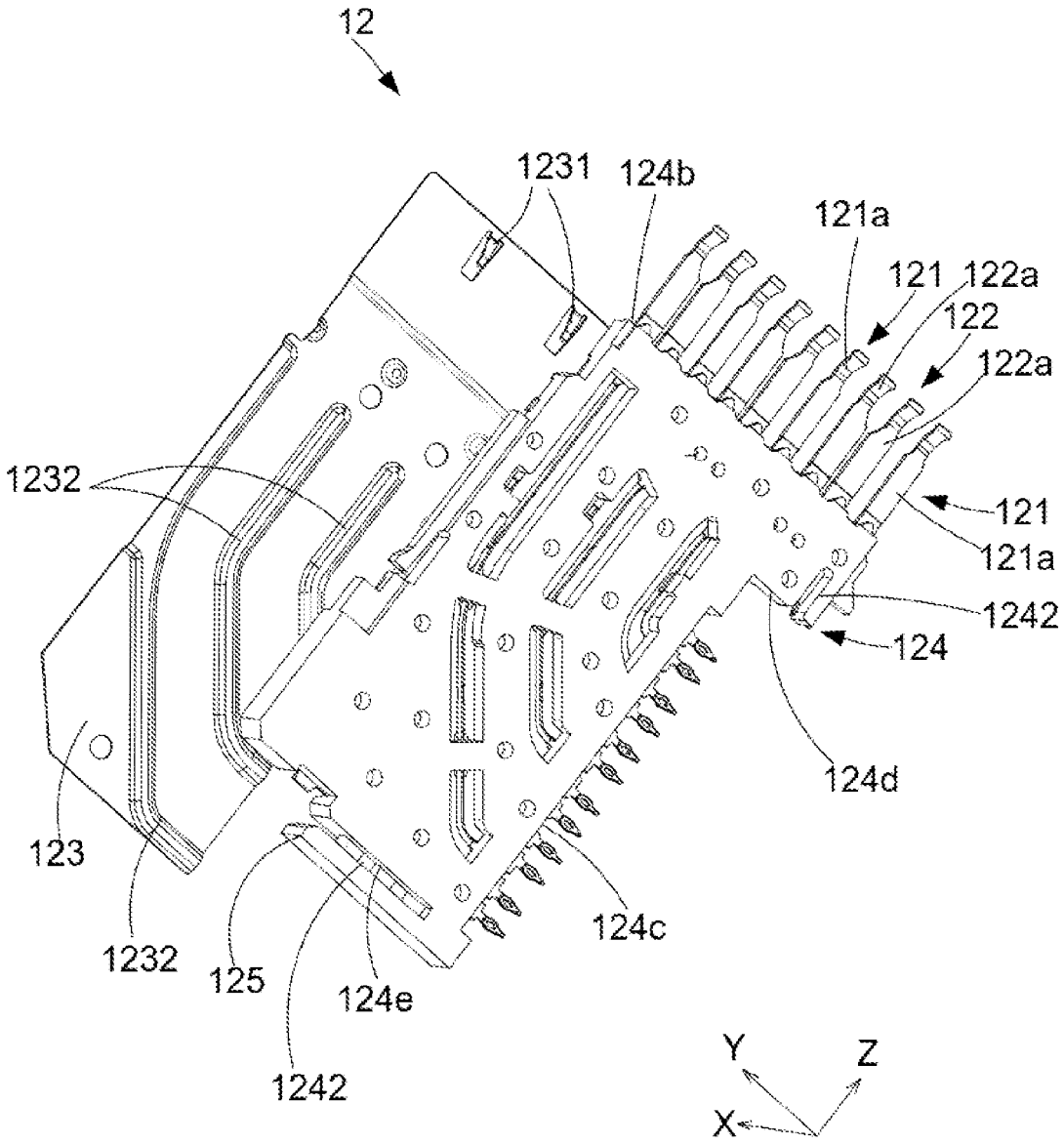
FIG. 7 is another exploded view of the terminal module of the first embodiment of the present disclosure.

FIG. 6 and FIG. 7 are exploded views of a terminal module of the first embodiment of the present disclosure. As shown in the figures, each of the terminal modules 12 comprises a plurality of ground terminals 121, a plurality of signal terminals 122, and a terminal electromagnetic shielding member 123. The plurality of ground terminals 121 and the plurality of signal terminals 122 are disposed on a plane along the second direction Y at intervals. The terminal electromagnetic shielding member 123 is disposed on one side of the plurality of ground terminals 121 and the plurality of signal terminals 122 which are disposed on the plane at intervals, and the terminal electromagnetic shielding member 123 is connected to the plurality of ground terminals 121. Each of the ground terminals 121 comprises a ground plugging end 121*a* and a ground connecting end 121*b*, and each of the signal terminals 122 comprises a signal plugging end 122*a* and a signal connecting end 122*b*. Each of the terminal modules 12 is disposed on one side of the first surface 101 of the insulating housing 10. The plurality of ground terminals 121 enter the plurality of ground terminal plugging holes 1032 of the corresponding terminal plugging hole group 103, and the plurality of signal terminals 122 enter the plurality of signal terminal plugging holes 1031 of the corresponding terminal plugging hole group 103. In this embodiment, the ground plugging end 121*a* of each of the ground terminals 121 enters the corresponding ground terminal plugging hole 1032, and the signal plugging end 122*a* of each of the signal terminals 122 enters the corresponding signal terminal plugging hole 1031 (shown in FIG. 4). The terminal electromagnetic shielding member 123 enters the shield accommodating groove 104 disposed at one side of the corresponding terminal plugging hole group 103. The plurality of connecting bumps 111 correspond to a surface of the terminal electromagnetic shielding member 123 close to the plurality of ground terminals 121 and the plurality of signal terminals 122. In other words, by approaching or contacting with the terminal electromagnetic shielding member 123, the plurality of connecting bumps 111 could ground the housing electromagnetic shielding member 11 to perform electromagnetic shielding. In this embodiment, the housing electromagnetic shielding member 11 has been integrated with the insulating housing 10. When the plurality of terminal modules 12 are assembled onto the insulating housing 10, the housing electromagnetic shielding member 11 would not be displaced to enable the terminal electromagnetic shielding member 123 of the terminal module 12 to be accurately connected to the plurality of connecting bumps 111 of the housing electromagnetic shielding member 11. In this embodiment, the plurality of connecting bumps 111 of the housing electromagnetic shielding member 11 can be directly contacted with the terminal electromagnetic shielding member 123 of the terminal module 12 to allow the housing electromagnetic shielding member 11 to be effectively connected with each of the terminal electromagnetic shielding members 123 to ensure the housing electromagnetic shielding member 11 could perform electromagnetic shielding, thereby improving the signal transmission performance of the electrical connector 1.

In this embodiment, the arrangement order of the plurality of ground terminals 121 and the plurality of signal terminals 122 of each of the terminal modules 12 is determined by the arrangement order of the corresponding plurality of signal terminal plugging holes 1031 and plurality of ground terminal plugging holes 1032 of the terminal plugging hole group 103. In this embodiment, since two signal terminal plugging holes 1031 are disposed between two adjacent ground terminal plugging holes 1032, there would be two signal terminals 122 disposed between two adjacent ground terminals 121. The circuit board 13 is disposed on one side of the plurality of terminal modules 12. The ground connecting end 121*b* of each of the ground terminals 121 and the signal connecting end 122*b* of each of the signal terminals 122 are plugged onto the circuit board 13.

Figure 8:
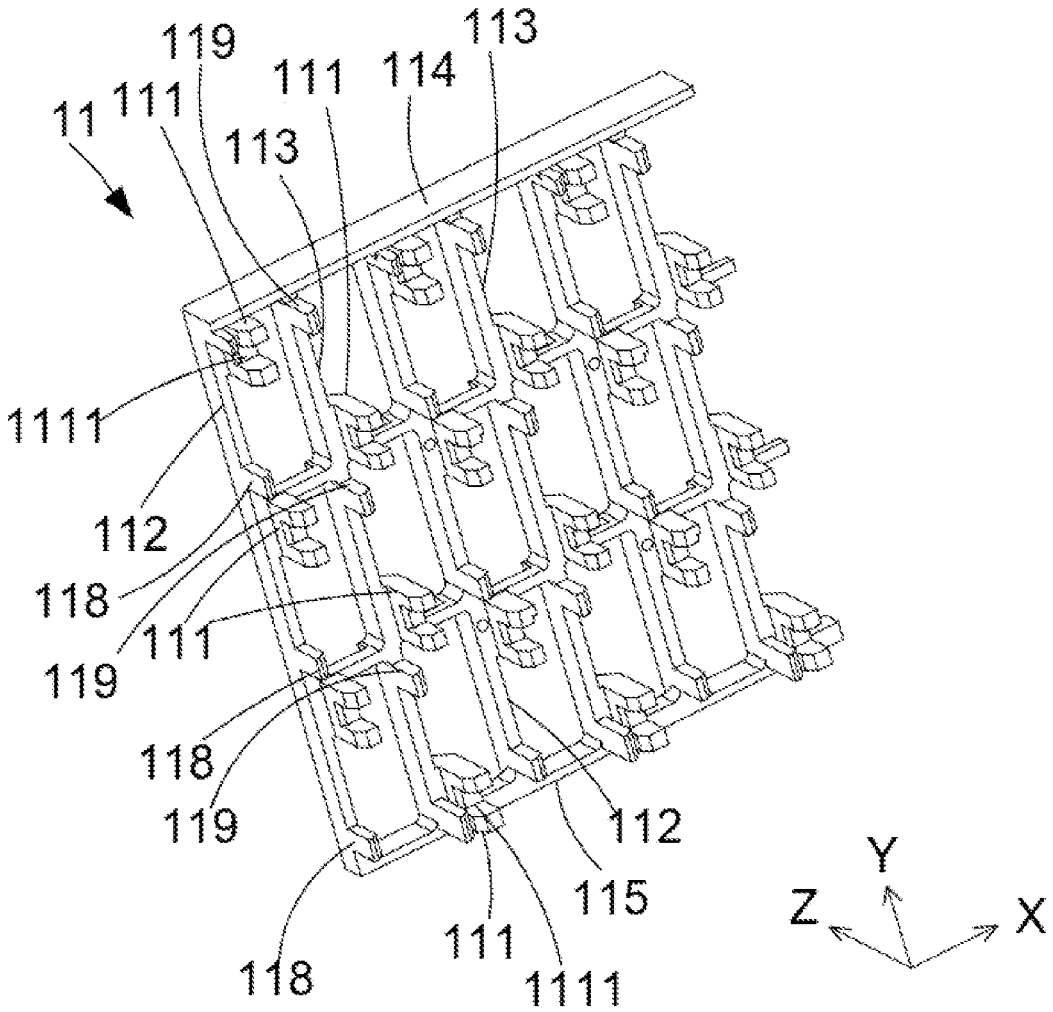
FIG. 8 is a perspective view of a housing electromagnetic shielding member of the first embodiment of the present disclosure.
Figure 9:
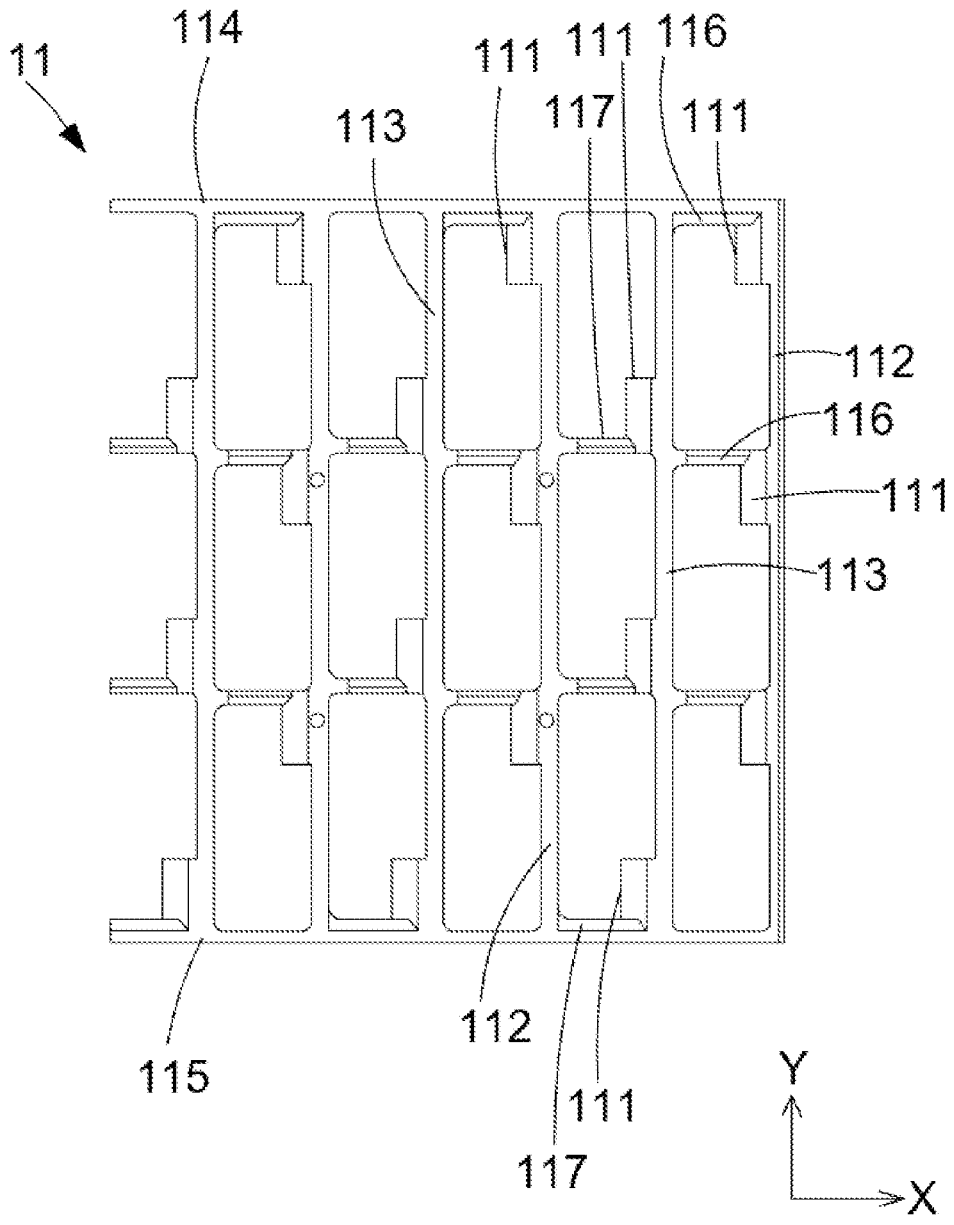
FIG. 9 is a front view of the housing electromagnetic shielding member of the first embodiment of the present disclosure.

The configuration of the electromagnetic shielding member 11 would be described in detail as follows. FIG. 8 and FIG. 9 are perspective view and front view of a housing electromagnetic shielding member of the first embodiment of the present disclosure. As shown in the figures, the housing electromagnetic shielding member 11 of this embodiment further comprises a plurality of first shielding columns 112, a plurality of second shielding columns 113, a first connecting beam 114, and a second connecting beam 115. The plurality of first shielding columns 112 and the plurality of second shielding columns 113 are alternately disposed at intervals along the first direction X. One ends of the plurality of first shielding columns 112 and one ends of the plurality of second shielding columns 113 are connected to the first connecting beam 114, and the other ends of the plurality of first shielding columns 112 and the other ends of the plurality of second shielding columns 113 are connected to the second connecting beam 115. The second connecting beam 115 is opposite to and parallel to the first connecting beam 114. The first connecting beam 114 and the second connecting beam 115 extend along the first direction X.

The plurality of connecting bumps 111 are respectively disposed at one side of the plurality of first shielding columns 112 and of the plurality of second shielding columns 113, and the plurality of connecting bumps 111 extend along a third direction Z and protrude from one side of the plurality of first shielding columns 112 and of the plurality of second shielding columns 113 in the third direction Z. An accommodating gap exists between each of the connecting bumps 111 and the corresponding first shielding column 112 or second shielding column 113. The accommodating gap is configured to accommodate the terminal electromagnetic shielding member 123 of the corresponding terminal module 12 (shown in FIG. 5), so each of the connecting bumps 111 could correspond to a surface of the terminal electromagnetic shielding member 123 close to the plurality of ground terminals 121 and the plurality of signal terminals 122. The plurality of connecting bumps 111 disposed on the first shielding column 112 at equal intervals, and the plurality of connecting bumps 111 disposed on the second shielding column 113 are disposed at equal intervals. The plurality of connecting bumps 111 disposed on the first shielding column 112 and the plurality of connecting bumps 111 disposed on the second shielding column 113 are alternately arranged. The connecting bump 111 disposed on the first shielding column 112 and close to the first connecting beam 114 is connected to the first connecting beam 114. The connecting bump 111 disposed on the second shielding column 113 and close to the second connecting beam 115 is connected to the second connecting beam 115.

Figure 10:
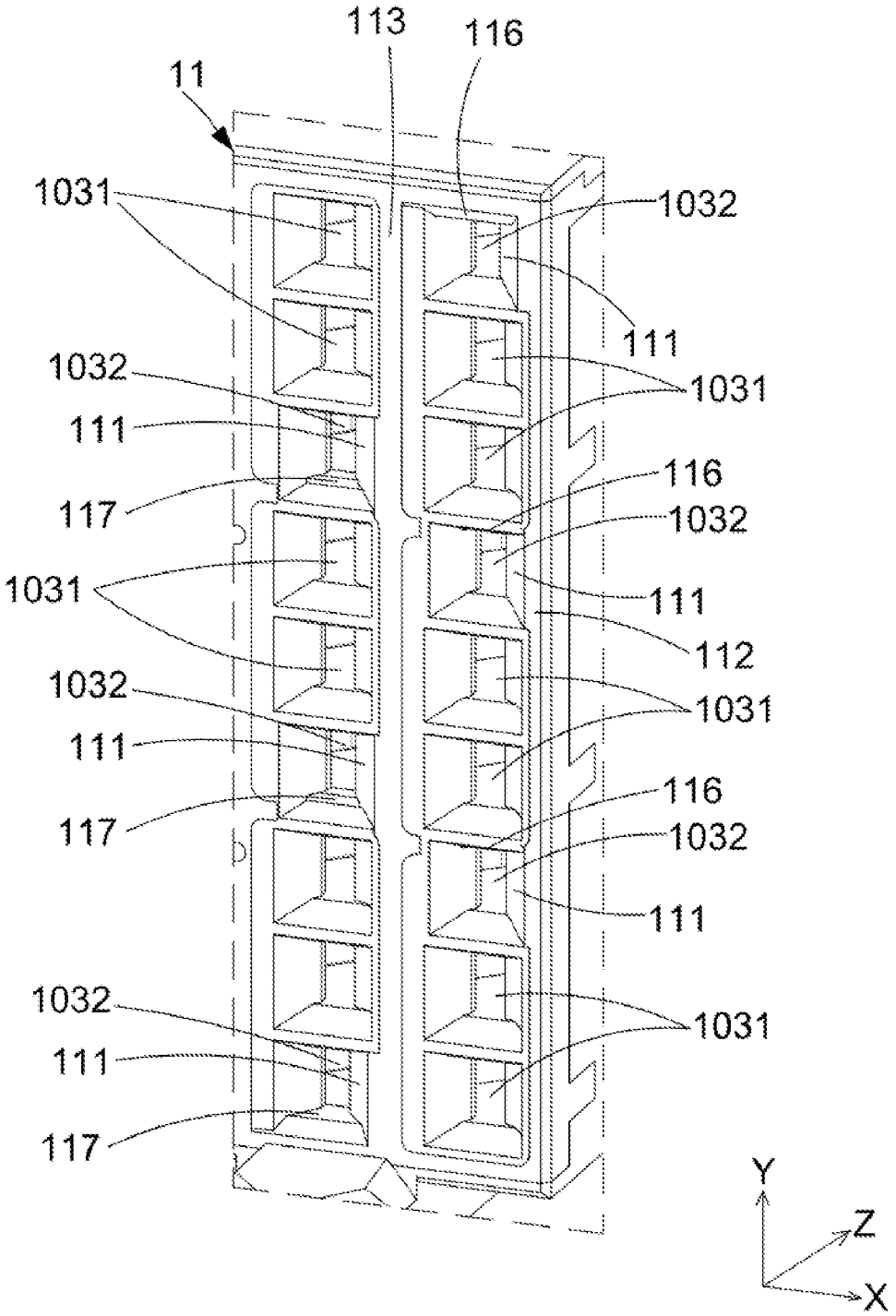
FIG. 10 is an enlarged view of area B of FIG. 1.

In one embodiment, the housing electromagnetic shielding member 11 further comprises a plurality of first extension shielding beams 116 and a plurality of second extension shielding beams 117. One ends of the plurality of first extension shielding beams 116 are respectively connected with the plurality of connecting bumps 111 disposed on one side of the plurality of first shielding columns 112, and the other ends of the plurality of first extension shielding beams 116 are respectively connected with the corresponding second shielding columns 113. Similarly, the plurality of second extension shielding beams 117 are respectively connected with the plurality of connecting bumps 111 disposed on one side of the plurality of second shielding columns 113, and the other ends of the plurality of second extension shielding beams 117 are respectively connected with the corresponding first shielding column 112. The plurality of first extension shielding beams 116 or the plurality of second extension shielding beams 117 disposed between the adjacent first shielding column 112 and the second shielding column 113 are arranged along the second direction Y at intervals. The plurality of first extension shielding beams 116 and the plurality of second extension shielding beams 117 extend along the second direction Y, and the extending direction of the first extension shielding beam 116 is opposite to the extending direction of the second extension shielding beam 117. Referring to FIG. 10, an enlarged view of area B of FIG. 1, as shown in the figure, when the housing electromagnetic shielding member 11 is embedded onto the second surface 102 of the insulating housing 10, the plurality of first extension shielding beams 116 and the plurality of second extension shielding beams 117 are respectively exposed from a sidewall of the corresponding ground terminal plugging holes 1032 in the second direction Y. Through the arrangement of the plurality of first extension shielding beams 116 and the plurality of second extension shielding beams 117, the housing electromagnetic shielding member 11 can be divided into a plurality of shielding areas. Each of the shielding areas comprises one ground terminal plugging hole 1032 and two signal terminal plugging holes 1031. The housing electromagnetic shielding member 11 could further prevent the two signal terminals 122 of the two signal terminal plugging holes 1031 inserted in each of the shielding areas from crosstalking with the two signal terminals 122 of the two signal terminal plugging holes 1031 inserted in adjacent shielding areas during signal transmission to enhance the electromagnetic shielding performance of the housing electromagnetic shielding member 11.

In one embodiment, back to FIG. 5, FIG. 6, and FIG. 8, each of the connecting bumps 111 comprises a positioning gap 1111 disposed at one end of the connecting bump 111 away from the corresponding first shielding column 112 or the second shielding column 113. The positioning gap 1111 extends along the third direction Z. The terminal electromagnetic shielding member 123 of each of the terminal modules 12 comprises a plurality of positioning elastic pieces 1231 disposed along the first direction X at intervals. The plurality of positioning elastic pieces 1231 are disposed at one side of the terminal electromagnetic shielding member 123 close to the ground plugging end 121*a* of the ground terminal 121 and the signal plugging end 122*a* of the signal terminal 122. When each of the terminal modules 12 is disposed on the first surface 101 of the insulating housing 10, the terminal electromagnetic shielding member 123 would enter the corresponding shield accommodating groove 104, and the plurality of positioning elastic pieces 1231 would be respectively disposed in the positioning gaps 1111 of the corresponding connecting bumps 111. Thus, the terminal electromagnetic shielding member 123 can be positioned in the corresponding shield accommodating groove 104.

In one embodiment, the housing electromagnetic shielding member 11 further comprises a plurality of first connecting columns 118 and a plurality of second connecting columns 119. The plurality of first connecting columns 118 are disposed on one side of the plurality of first shielding columns 112 close to the first surface 101 of the insulating housing 10 and respectively extend along the third direction Z. The plurality of first connecting columns 118 and the connecting bump 111 disposed on a first shielding column 112 are arranged at intervals and are disposed at one side of the corresponding connecting bumps 111. The plurality of second connecting columns 119 are respectively disposed on one side of the plurality of second shielding columns 113 close to the first surface 101 of the insulating housing 10 and respectively extend along the third direction Z. The plurality of second connecting columns 119 and the connecting bump 111 disposed on a second shielding column 113 are arranged at intervals and are disposed at one side of the corresponding connecting bumps 111. The plurality of first connecting columns 118 on each of the first shielding columns 112 and the plurality of second connecting columns 119 on each of the second shielding columns 113 are alternately arranged. In this embodiment, the plurality of first connecting columns 118 disposed on each of the first shielding columns 112 respectively correspond to the plurality of connecting bumps 111 disposed on each of the second shielding columns 113, and the plurality of second connecting columns 119 disposed on each of the second shielding columns 113 respectively correspond to the plurality of connecting bumps 111 disposed on each of the first shielding columns 112. When the housing electromagnetic shielding member 11 is embedded onto the insulating housing 10, the adhesion between the electromagnetic shielding member 11 and the insulating housing 10 could be increased by extending the plurality of first connecting columns 118 and the plurality of second connecting columns 119 into the insulating housing 10. Meanwhile, when the terminal electromagnetic shielding member 123 of each of the terminal modules 12 is disposed in the corresponding shield accommodating groove 104, the plurality of first connecting columns 118 or the plurality of second connecting columns 119 would be respectively exposed from a sidewall of the corresponding shield accommodating grooves 104 to increase the connection position between the housing electromagnetic shielding member 11 and the terminal electromagnetic shielding member 123 and to improve the performance electromagnetic shielding.

The configuration of the terminal module 12 would be described in detail as follows. Back to FIG. 5, FIG. 6, and FIG. 7, in this embodiment, the terminal module 12 further comprises an insulating body 124 in which the plurality of ground terminals 121 and the plurality of signal terminals 122 are disposed. The insulating body 124 is formed on the plurality of ground terminals 121 and the plurality of signal terminals 122 by injection molding. The insulating body 124 comprises a first insulating surface 124*a*, a first side edge 124*b*, and a second side edge 124*c*, wherein the first side edge 124*b* is disposed on one side of the first insulating surface 124*a* in the third direction Z, and the second side edge 124*c* is disposed on one side of the first insulating surface 124*a* in the second direction Y. The extending direction of the first side edge 124*b* is orthogonal to the extending direction of the second side edge 124*c*. The ground plugging end 121*a* of each of the ground terminals 121 and the signal plugging end 122*a* of each of the signal terminals 122 protrude from the first side edge 124*b* of the insulating body 124. The ground connecting end 121*b* of each of the ground terminals 121 and the signal connecting end 122*b* of each of the signal terminals 122 protrude from the second side edge 124*c* of the insulating body 124. The first insulating surface 124*a* of the insulating body 124 comprises a plurality of hollow parts 1241. The plurality of ground terminals 121 are exposed from the corresponding hollow parts 1241. The terminal electromagnetic shielding member 123 is disposed on one side of the first insulating surface 124*a* of the insulating body 124. The terminal electromagnetic shielding member 123 is connected to the corresponding plurality of ground terminals 121 through a plurality of hollow parts 1241. A surface of the terminal electromagnetic shielding member 123 close to the insulating body 124 further comprises a plurality of connecting bumps 1232 disposed at intervals. The plurality of connecting bumps 1232 respectively enter the corresponding hollow parts 1241 and are respectively connected to the ground terminals 121 exposed from the corresponding hollow parts 1241.

Figure 11:
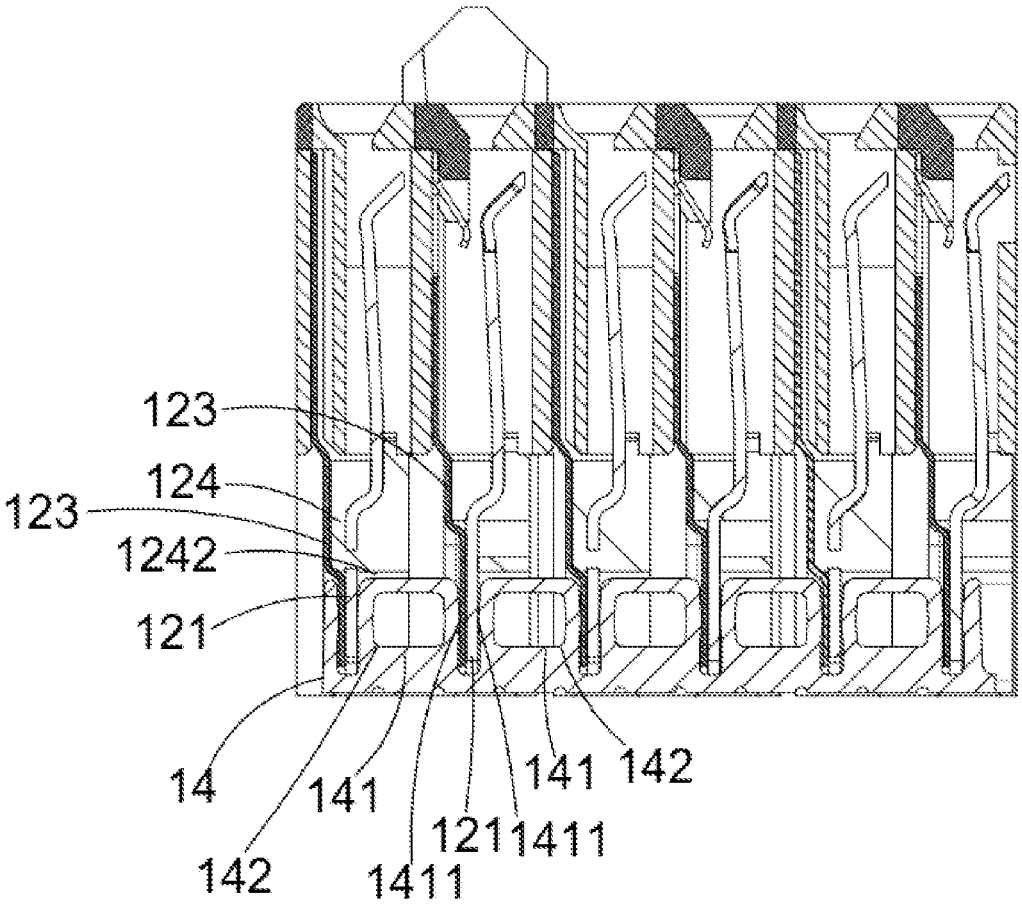
FIG. 11 is a cross-sectional view along line B-B' in FIG. 1.

In an embodiment, the insulating body 124 of each of the terminal modules 12 further comprises a third side edge 124*d*, which is opposite to the first side edge 124*b* and is disposed on one side of the second side edge 124*c* close to the first side edge 124*b*. The third side edge 124*d* is disposed between the first side edge 124*b* and the second side edge 124*c*. The third side edge 124*d* comprises a notch 1242. The ground terminal 121 and the terminal electromagnetic shielding member 123 are exposed from one side of the notch 1242. FIG. 11 is a cross-sectional view along line B-B' in FIG. 1. As shown in the figure, the electrical connector 1 of this embodiment further comprises a shield connecting member 14. The shield connecting member 14 is disposed on the third side edge 124*d* of the insulating body 124 of each of the terminal modules 12 and is connected to the ground terminal 121 and the terminal electromagnetic shielding member 123 of each of the terminal modules 12. The shield connecting member 14 comprises a plurality of bumps 141 disposed at intervals. Each of the bumps 141 enters the corresponding notch 1242. The ground terminal 121 and the terminal electromagnetic shielding member 123 of each of the terminal modules 12 are disposed between two adjacent bumps 141 so that the shield connecting member 14 can be connected to the ground terminal 121 and the terminal electromagnetic shielding member 123 of each of the terminal modules 12, and meanwhile to connect a plurality of terminal modules 12 in series to integrate the plurality of terminal modules 12. In this embodiment, a side edge of each of the bumps 141 close to the adjacent bump 141 comprises an arc-shaped bump section 1411. Each of the arc-shaped bump sections 1411 protrudes toward the adjacent bump 141. The arc-shaped bump section 1411 of each of the bumps 141 is opposite to the arc-shaped bump section 1411 of the adjacent bump 141 to shorten the distance between two adjacent bumps 141. Thus, the shield connecting member 14 can be stably connected with the ground terminal 121 and the terminal electromagnetic shielding member 123 of each of the terminal modules 12. In one embodiment, the shield connecting member 14 further comprises a plurality of through holes 142 respectively disposed on the corresponding bumps 141. In this way, the two arc-shaped bump sections 1411 on two sides of the through hole 142 can be elastically compressed into the through hole 142. Each of the bumps 141 could elastically adjust the two arc-shaped bump sections 1411 disposed on two sides of the through hole 142 with the arrangement of the through hole 142. The distance between the two arc-shaped bump sections 1411 of two adjacent bumps 141 can be elastically adjusted according to the thickness of the ground terminal 121 and the terminal electromagnetic shielding member 123. When the shielding connecting member 14 is disposed in the plurality of terminal modules 12, the ground terminal 121 and the terminal electromagnetic shielding member 123 of each of the terminal modules 12 would enter the gap between two adjacent bumps 141. The corresponding arc-shaped bump section 1411 is compressed by the ground terminal 121 and the terminal electromagnetic shielding member 123 of each of the terminal modules 12 to move into the corresponding through hole 142. The compressed arc-shaped bump section 1411 abuts against the corresponding ground terminal 121 and the terminal electromagnetic shielding member 123 by its elasticity to ensure that the two adjacent arc-shaped bump sections 1411 can be effectively fixed to the corresponding ground terminal 121 and terminal electromagnetic shielding member 123. Thus, the shield connecting member 14 can be stably connected with the ground terminal 121 and the terminal electromagnetic shielding member 123 of each of the terminal modules 12. The shield connecting member 14 of this embodiment is made of conductive material, such as metal, conductive plastic, or electroplated plastic.

Figure 12:
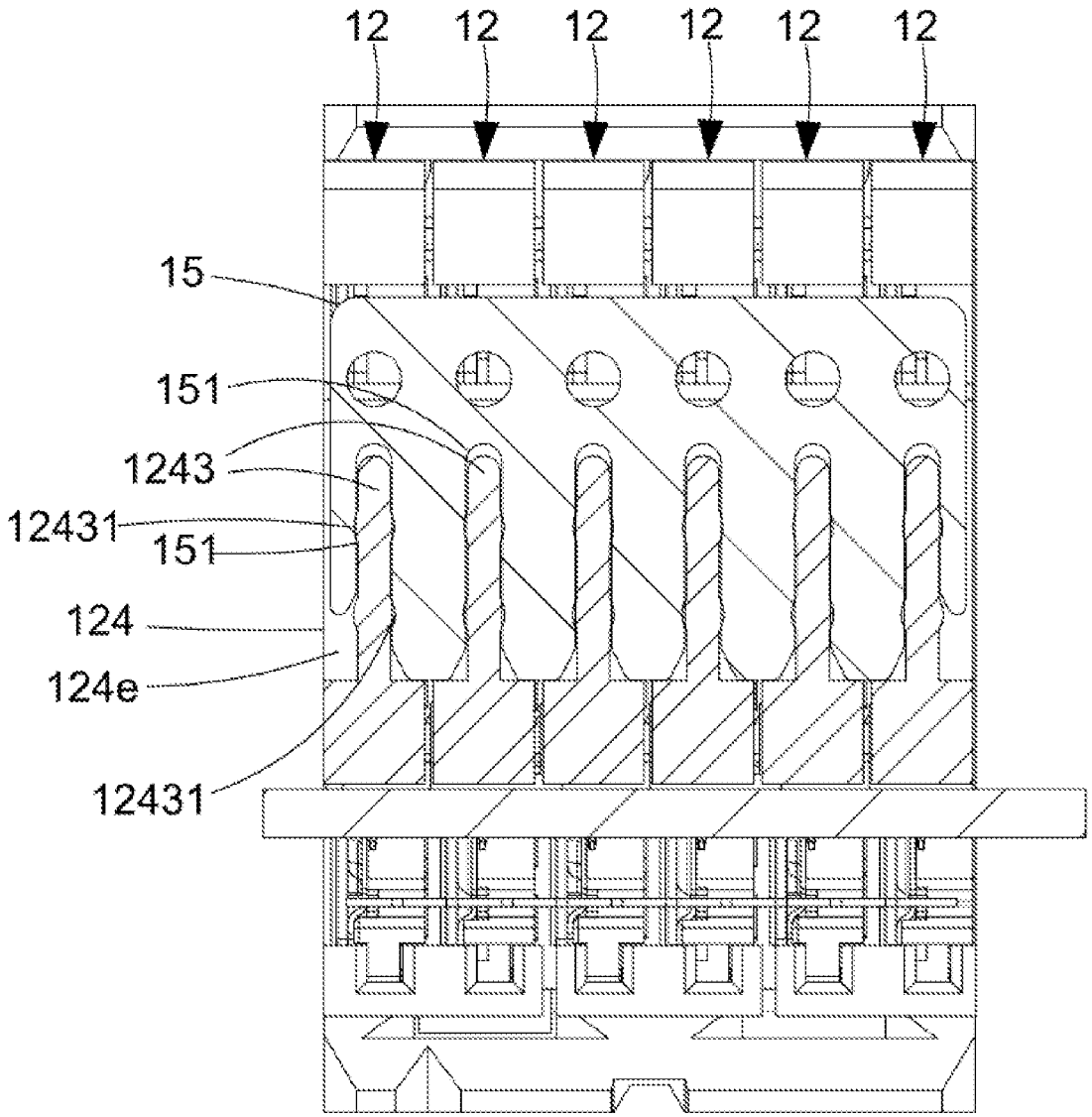
FIG. 12 is a cross-sectional view along line C-C' in FIG. 2.

FIG. 12 is a cross-sectional view along line C-C' in FIG. 2. As shown in the figure, the insulating body 124 of each of the terminal modules 12 of this embodiment further comprises a fourth side edge 124*e* opposite to the first side edge 124*b*. The fourth side edge 124*e* is disposed on one side of the second side edge 124*c* away from the first side edge 124*b*. The fourth side edge 124*e* of each of the insulating bodies 124 is further provided with a positioning column 1243 extending along the second direction Y. In this embodiment, the electrical connector 1 further comprises a connecting member 15 connected with a plurality of insulating bodies 124 of the plurality of terminal modules 12. The connecting member 15 comprises a plurality of recesses 151 disposed at intervals. When the connecting member 15 is disposed at one side of the fourth side edge 124*e* of the insulating body 124 of each of the terminal modules 12, the positioning column 1243 of each of the insulating bodies 124 would enter the corresponding recess 151, and the connecting member 15 between two adjacent recesses 151 would be disposed between two adjacent positioning columns 1243. In one embodiment, two opposite sides of each of the positioning columns 1243 are respectively provided with an interfering bump 12431 interfering with a sidewall of the recess 151. Thus, the connecting member 15 can be stably disposed on the plurality of positioning columns 1243, allowing the connecting member 15 to be firmly connected with the plurality of insulating bodies 124 of the plurality of terminal modules 12. In one embodiment, one side of the positioning column 1243 of each of the terminal modules 12 away from the insulating body 124 is further provided with a stopping member 125 (shown in FIG. 7). When the connecting member 15 is connected to the plurality of insulating bodies 124 of the plurality of terminal modules 12, each of the stopping members 125 would be disposed on one side of the corresponding connecting member 15 away from the corresponding insulating body 124, and the stopping members 125 of each of the terminal modules 12 blocks the connecting member 15 from being detached from the plurality of positioning columns 1243.

Figure 13:
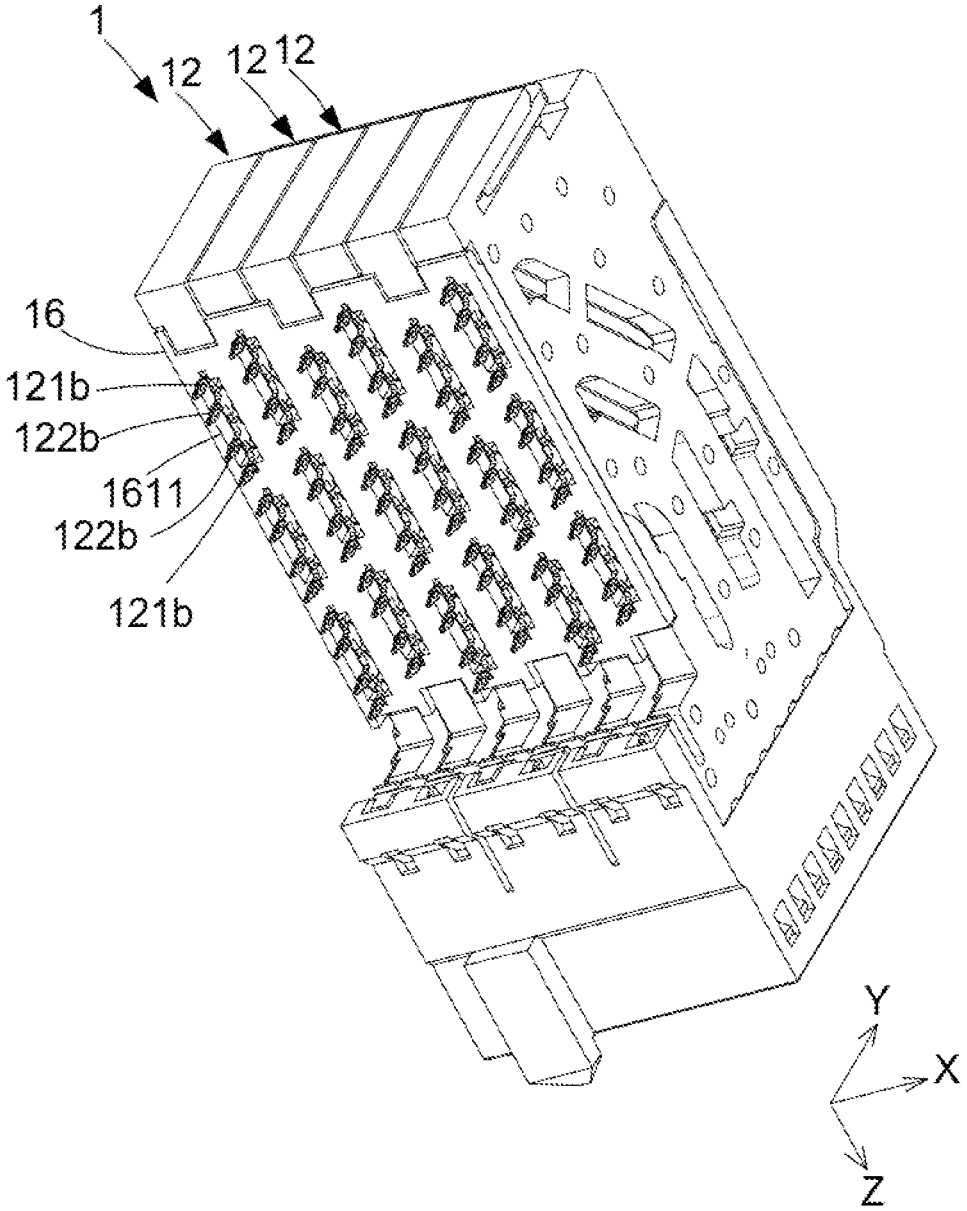
FIG. 13 is a schematic diagram of an electromagnetic shielding member installed on the plurality of terminal modules of the first embodiment of the present disclosure.

FIG. 13 is a schematic diagram of an electromagnetic shielding member installed on the plurality of terminal modules of the first embodiment of the present disclosure. Referring to FIG. 13 with FIG. 3, the electrical connector 1 of this embodiment further comprises an electromagnetic shielding member 16 disposed on one side of the plurality of terminal modules 12. In this embodiment, the electromagnetic shielding member 16 is disposed between the plurality of terminal modules 12 and the circuit board 13. The ground connecting end 121*b* of each of the ground terminals 121 and the signal connecting end 122*b* of each of the signal terminals 122 pass through the electromagnetic shielding member 16. The electromagnetic shielding member 16 is connected with the ground connecting end 121*b* of each of the ground terminals 121 so that the mutual crosstalk among the plurality of signal connecting ends 122*b* of the plurality of signal terminals 122 could be reduced, presenting the effect of electromagnetic shielding. Specifically, the electromagnetic shielding member 16 comprises a plurality of accommodating grooves 161 disposed along the first direction X at intervals. Each of the accommodating grooves 161 extends along the third direction Z. The bottom surface of the accommodating groove 161 comprises a plurality of terminal through holes 1611 arranged at intervals along the third direction Z. When the electromagnetic shielding member 16 is disposed at the plurality of terminal modules 12, each of the terminal modules 12 would be disposed in the corresponding accommodating groove 161, the ground connecting end 121*b* of each of the ground terminals 121 and the signal connecting end 122*b* of each of the signal terminals 122 of each of the terminal modules 12 would pass through the corresponding terminal through hole 1611, the ground connecting end 121*b* of each of the ground terminals 121 would be connected to a sidewall of the terminal through hole 1611, and the terminal electromagnetic shielding member 123 of each of the terminal modules 12 would be connected to the sidewall of the terminal through hole 1611. In this embodiment, the material of the electromagnetic shielding member 16 is a conductive material, such as metal, conductive plastic, or electroplated plastic.

Figure 14:
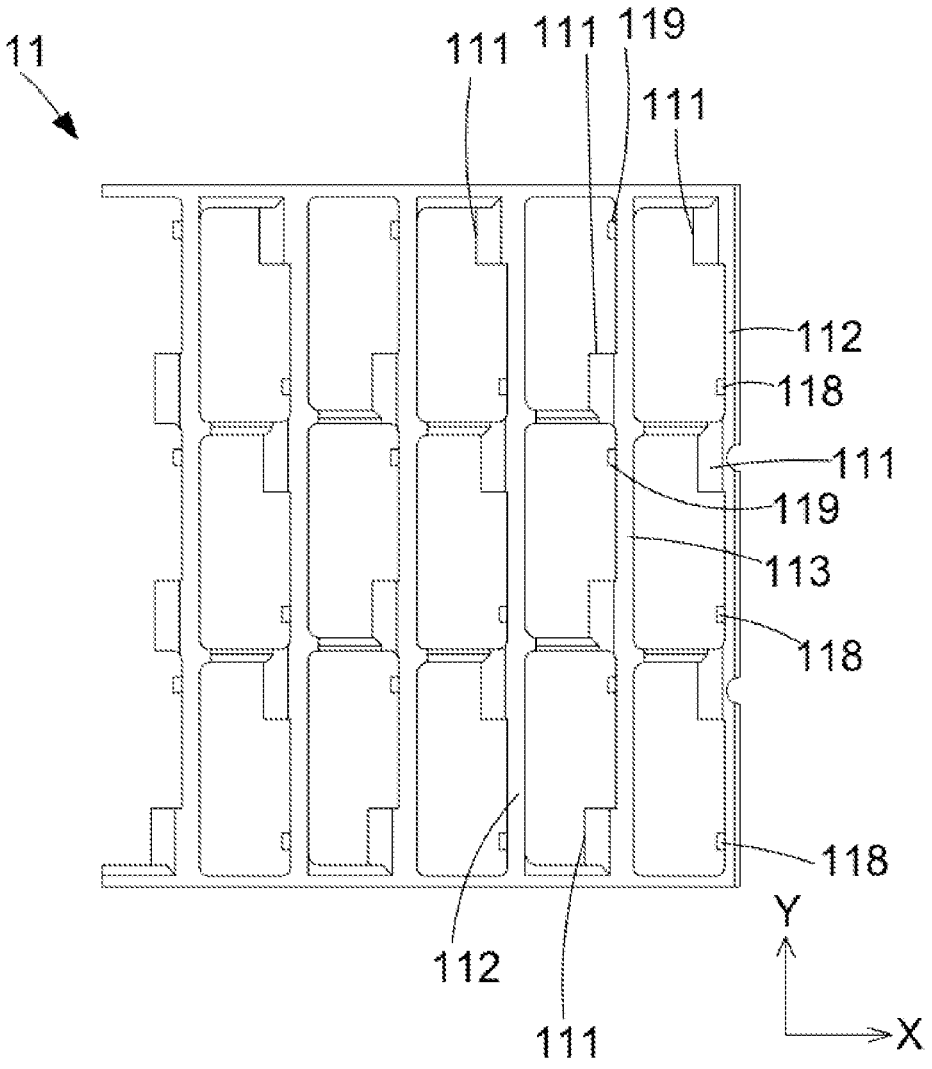
FIG. 14 is a front view of a housing electromagnetic shielding member of the second embodiment of the present disclosure.
Figure 15:
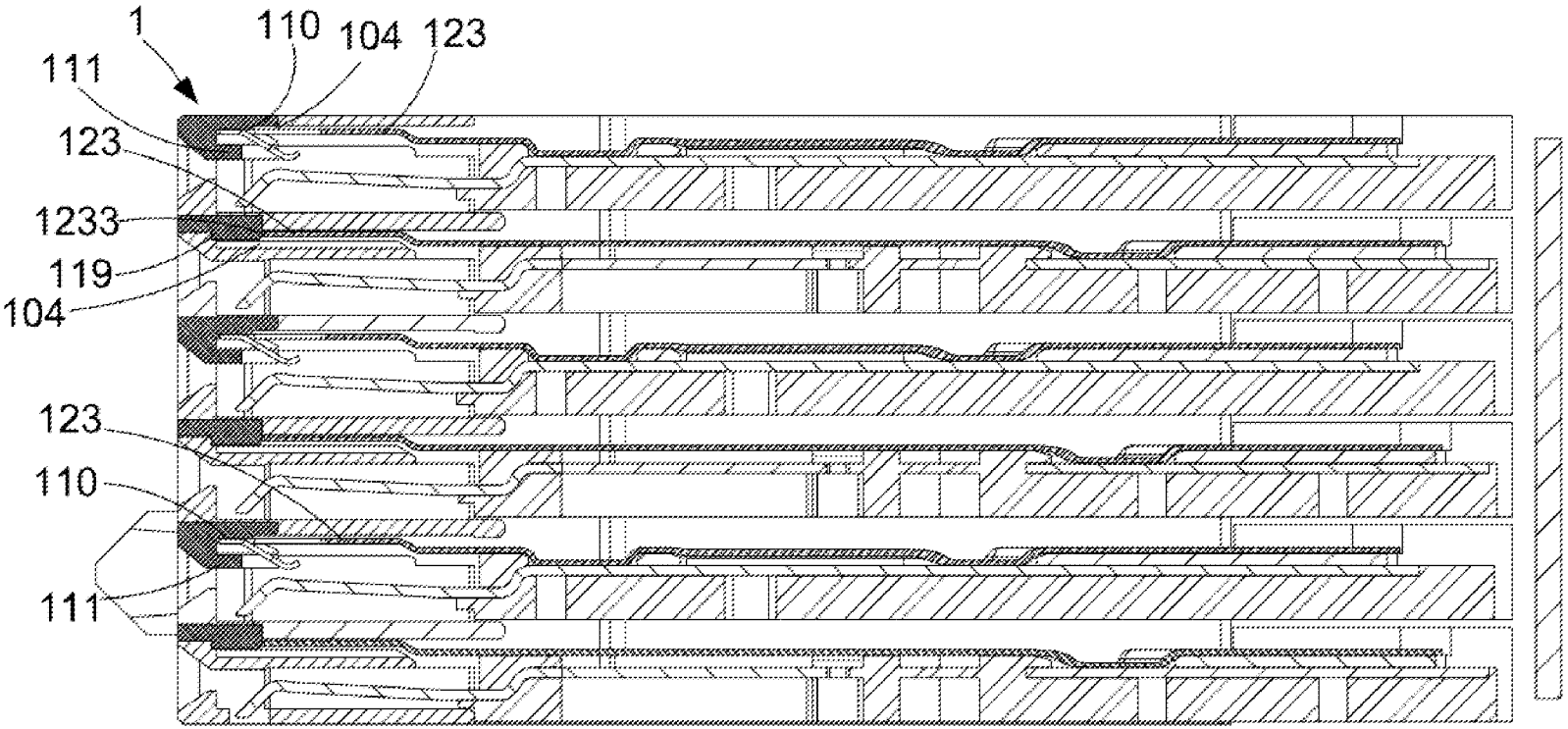
FIG. 15 is a cross-sectional view of an electrical connector of the second embodiment of the present disclosure.
Figure 16:
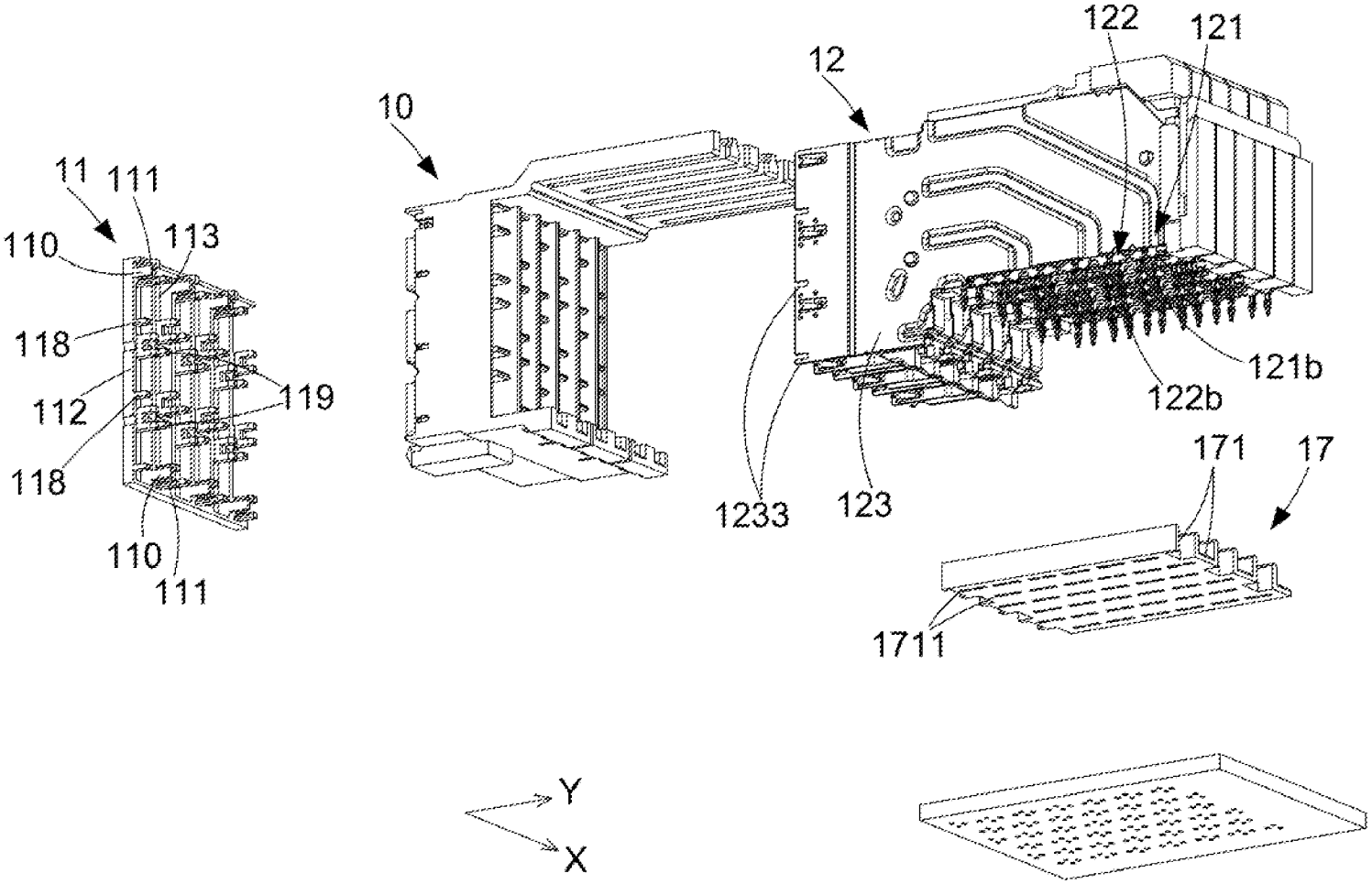
FIG. 16 is an exploded view of the electrical connector of the second embodiment of the present disclosure.

FIG. 14 is a front view of a housing electromagnetic shielding member of the second embodiment of the present disclosure. FIG. 15 and FIG. 16 are cross-sectional view and exploded view of an electrical connector of the second embodiment of the present disclosure. As shown in the figures, the electrical connector of this embodiment is different from that of the first embodiment lies in the housing electromagnetic shielding member 11 and the terminal electromagnetic shielding member 123. The plurality of first connecting columns 118 of the housing electromagnetic shielding member 11 respectively protrude from one side of the corresponding first shielding column 112 having the plurality of connecting bumps 111, and the plurality of second connecting columns 119 respectively protrude from one side of the corresponding second shielding column 113 having the plurality of connecting bumps 111. The terminal electromagnetic shielding member 123 of each of the terminal modules 12 comprises a plurality of positioning notches 1233 disposed on one side of the terminal electromagnetic shielding member 123 close to the insulating housing 10. When the terminal electromagnetic shielding member 123 is disposed in the corresponding shield accommodating groove 104, the plurality of first connecting columns 118 or the plurality of second connecting columns 119 would respectively enter the corresponding positioning notches 1233 to position the terminal electromagnetic shielding member 123 in the shield accommodating groove 104, which increases the connection position between the housing electromagnetic shielding member 11 and the terminal electromagnetic shielding member 123, thereby improving the performance of electromagnetic shielding.

In this embodiment, the housing electromagnetic shielding member 11 further comprises a plurality of contacting bumps 110 disposed at the plurality of first shielding columns 112 and the plurality of second shielding columns 113. Each of the contacting bumps 110 is opposite to the corresponding connecting bump 111 and protrudes from a sidewall of the shield accommodating groove 104. When the terminal electromagnetic shielding member 123 is disposed in the corresponding shield accommodating groove 104, the terminal electromagnetic shielding member 123 would be disposed between the contacting bump 110 and the connecting bump 111. Through the contact with the contacting bump 110, the terminal electromagnetic shielding member 123 and the connecting bump 111 are connected to ensure that the housing electromagnetic shielding member 11 can be effectively connected with each of the terminal electromagnetic shielding members 123 and to ensure that the housing electromagnetic shielding member 11 could perform electromagnetic shielding, thereby improving the signal transmission performance of the electrical connector 1.

In this embodiment, the electrical connector further comprises a bottom plate 17 replacing the electromagnetic shielding member of the first embodiment. The bottom plate 17 comprises a plurality of accommodating grooves 171 disposed along the first direction X at intervals. Each of the accommodating grooves 171 extends along a third direction Z, and a bottom surface of the accommodating groove 171 comprises a plurality of terminal through holes 1711 along the third direction Z arranged at intervals. When the bottom plate 17 is disposed in the plurality of terminal modules 12, each of the terminal modules 12 would be disposed in the corresponding accommodating groove 171, and the ground connecting end 121*b* of each of the ground terminals 121 and the signal connecting end 122*b* of each of the signal terminals 122 of each of the terminal modules 12 would pass through the corresponding terminal through holes 1711. The bottom plate 17 of this embodiment is made of insulating material.

In summary, embodiments of the present disclosure provide an electrical connector. By embedding the housing electromagnetic shielding member in the insulating housing, the housing electromagnetic shielding member and the insulating housing can be integrated. In this way, when the terminal module is assembled to the insulating housing, the terminal electromagnetic shielding member of the terminal module can be accurately connected to the housing electromagnetic shielding member, so that the terminal electromagnetic shielding member can be effectively connected to the housing electromagnetic shielding member to ensure that the housing electromagnetic shielding member could perform electromagnetic shielding, thereby improving the signal transmission performance of the electrical connector.

It is to be understood that the term "comprises", "comprising", or any other variants thereof, is intended to encompass a non-exclusive inclusion, such that a process, method, article, or device of a series of elements not only comprise those elements but further comprises other elements that are not explicitly listed, or elements that are inherent to such a process, method, article, or device. An element defined by the phrase "comprising a . . . " does not exclude the presence of the same element in the process, method, article, or device that comprises the element.

Although the present disclosure has been explained in relation to its preferred embodiment, it does not intend to limit the present disclosure. It will be apparent to those skilled in the art having regard to this present disclosure that other modifications of the exemplary embodiments beyond those embodiments specifically described here may be made without departing from the spirit of the disclosure. Accordingly, such modifications are considered within the scope of the disclosure as limited solely by the appended claims.

What is claimed is:

1. An electrical connector, comprising:

an insulating housing comprising a first surface, a second surface, a plurality of terminal plugging hole groups and a plurality of shield accommodating grooves, the first surface being opposite to the second surface, the plurality of terminal plugging hole groups being arranged at intervals, each of the terminal plugging hole groups comprising a plurality of ground terminal plugging holes and a plurality of signal terminal plugging holes penetrating the first surface and the second surface, each of the shield accommodating grooves being formed on the second surface and being disposed on one side of the corresponding terminal plugging hole group;

a housing electromagnetic shielding member embedded on the second surface, the housing electromagnetic shielding member comprising a plurality of connecting bumps, each of the connecting bumps being disposed in the ground terminal plugging hole and at one side of the corresponding shield accommodating groove; and a plurality of terminal modules disposed on the first surface, each of the terminal modules comprising a plurality of ground terminals, a plurality of signal terminals and a terminal electromagnetic shielding member, the plurality of ground terminals being disposed in the plurality of ground terminal plugging holes of the corresponding terminal plugging hole group, the plurality of signal terminals being disposed in the plurality of signal terminal plugging holes of the corresponding terminal plugging hole group, the terminal electromagnetic shielding member being disposed in the corresponding shield accommodating groove and connected with the corresponding plurality of connecting bumps.

2. The electrical connector according to claim 1, wherein the housing electromagnetic shielding member further comprises a plurality of first shielding columns, a plurality of second shielding columns, a first connecting beam and a second connecting beam; the plurality of first shielding columns and the plurality of the second shielding columns are alternately disposed at intervals; one end of each of the first shielding columns and one end of each of the second shielding columns are connected to the first connecting beam; the other end of each of the first shielding columns and the other end of each of the second shielding columns are connected to the second connecting beam; the plurality of connecting bumps are respectively disposed on one side of the plurality of first shielding columns and on one side of the plurality of second shielding columns; each of the of the connecting bumps corresponds to a surface of the terminal electromagnetic shielding member close to the plurality of ground terminals and the plurality of signal terminals.

3. The electrical connector according to claim 2, wherein the plurality of connecting bumps disposed on the first shielding column are arranged at intervals with equal distance; the plurality of connecting bumps disposed on the second shielding column are arranged at intervals with equal distance; the plurality of connecting bumps disposed at the first shielding column and the plurality of connecting bumps disposed at the second shielding column are alternately arranged.

4. The electrical connector according to claim 3, wherein each of the connecting bumps comprises a positioning gap; one side of the terminal electromagnetic shielding member is provided with a plurality of positioning elastic pieces; the plurality of positioning elastic pieces are respectively disposed in the corresponding positioning gaps.

5. The electrical connector according to claim 3, wherein the housing electromagnetic shielding member further comprises a plurality of first extension shielding beams and a plurality of second extension shielding beams; one ends of the plurality of first extension shielding beams are respectively connected to the plurality of connecting bumps disposed on one side of the plurality of first shielding columns; the other ends of the plurality of first extension shielding beams are respectively connected to the corresponding second shielding columns; one ends of the plurality of second extension shielding beams are respectively connected to the plurality of connecting bumps disposed on one side of the plurality of second shielding columns; the other ends of the plurality of second extension shielding beams are respectively connected to the corresponding first shielding columns; the plurality of first extension shielding beams and the plurality of second extension shielding beams are respectively exposed from a sidewall of the corresponding ground terminal plugging holes.

6. The electrical connector according to claim 3, wherein the housing electromagnetic shielding member further comprises a plurality of first connecting columns and a plurality of the second connecting columns; the plurality of first connecting columns are respectively disposed on one side of the plurality of first shielding columns close to the first surface; the plurality of second connecting columns are respectively disposed on one side of the plurality of second shielding columns close to the first surface; the plurality of first connecting columns and the plurality of the second connecting columns extend into the insulating housing.

7. The electrical connector according to claim 6, wherein each of the first connecting columns protrudes from one side of the corresponding first shielding column having the plurality of the connecting bumps; each of the second connecting columns protrudes from one side of the corresponding second shielding column having the plurality of the connecting bumps; each of the terminal electromagnetic shielding members further comprises a plurality of positioning notches; each of the first connecting columns and each of the second connecting columns are disposed in the corresponding positioning notches.

8. The electrical connector according to claim 6, wherein the plurality of first connecting columns disposed on each of the first shielding columns and the plurality of second connecting columns disposed on each of the second shielding columns are alternately arranged.

9. The electrical connector according to claim 6, wherein the plurality of first connecting columns disposed on each of the first shielding columns respectively correspond to the plurality of connecting bumps disposed on each of the second shielding columns; the plurality of second connecting columns disposed on each of the second shielding columns respectively correspond to the plurality of connecting bumps disposed on each of the first shielding columns.

10. The electrical connector according to claim 2, wherein the housing electromagnetic shielding member further comprises a plurality of contacting bumps disposed at the plurality of first shielding columns and the plurality of second shielding columns; each of the contacting bumps is opposite to the corresponding connecting bump; each of the contacting bumps protrudes from a sidewall of the shield accommodating groove and is connected to the corresponding terminal electromagnetic shielding member.

11. The electrical connector according to claim 1, wherein each of the ground terminals comprises a ground plugging end and a ground connecting end; each of the signal terminals comprises a signal plugging end and a signal connecting end; the ground plugging end of each of the ground terminals is disposed in the corresponding ground terminal plugging hole; the signal plugging end of each of the signal terminals is disposed in the corresponding signal terminal plugging hole.

12. The electrical connector according to claim 11, wherein each of the terminal modules further comprises an insulating body comprising a first insulating surface, a first side edge, and a second side edge; the first side edge and the second side edge are disposed on two sides of the first insulating surface; the plurality of the ground terminals and the plurality of the signal terminals are disposed on the insulating body; the ground plugging end of each of the ground terminals and the signal plugging end of each of the signal terminals protrude from the first side edge; the ground connecting end of each of the ground terminals and the signal connecting end of each of the signal terminals protrude from the second side edge; the terminal electromagnetic shielding member is disposed on the first insulating surface and is connected to the plurality of ground terminals.

13. The electrical connector according to claim 12, wherein the first insulating surface also comprises a plurality of hollow parts; each of the ground terminals is exposed from the corresponding hollow part; the terminal electromagnetic shielding member is connected to the plurality of ground terminals through the plurality of hollow parts; a surface of the electromagnetic shielding member close to the insulating body further comprises a plurality of connecting bumps; each of the connecting bumps respectively enters the corresponding hollow part.

14. The electrical connector according to claim 12 further comprising a shield connecting member, the shield connecting member being connected to a third side edge of the insulating body of each of the terminal modules and being connected to the ground terminal and the terminal electromagnetic shielding member of each of the terminal modules.

15. The electrical connector according to claim 14, wherein the third side edge comprises a notch; the ground terminal and the terminal electromagnetic shielding member are exposed from one side of the notch; the shield connecting member comprises a plurality of bumps; each of the bumps is disposed in the corresponding notch; the ground terminal and the terminal electromagnetic shielding member of each of the terminal modules are disposed between two adjacent bumps.

16. The electrical connector according to claim 15, wherein a side edge of each of the bumps close to the adjacent bump comprises an arc-shaped bump section.

17. The electrical connector according to claim 16, wherein the shield connecting member further comprises a plurality of through holes; each of the through holes is disposed at the corresponding bump.

18. The electrical connector according to claim 12 further comprising a connecting member comprising a plurality of recesses, each of the insulating bodies further comprising a fourth side edge opposite to the first side edge, the fourth side edge being disposed on one side of the second side edge away from the first side edge, a positioning column being disposed on the fourth side edge, the connecting member being disposed on one side of the fourth side edge of the insulating body of each of the terminal modules, the positioning column of each of the insulating bodies being disposed in the corresponding recess.

19. The electrical connector according to claim 11 further comprising an electromagnetic shielding member disposed on one side of the plurality of terminal modules, the signal connecting end of each of the signal terminals and the ground connecting end of each of the ground terminals passing through the electromagnetic shielding member, the electromagnetic shielding member being connected to the ground connecting end of each of the ground terminals.

20. The electrical connector according to claim 19, wherein the electromagnetic shielding member comprises a plurality of accommodating grooves and a plurality of terminal through holes; each of the terminal modules is disposed in the corresponding accommodating groove; the signal connecting end of each of the signal terminals and the ground connecting end of each of the ground terminals pass through the corresponding terminal through holes; the ground connecting end of each of the ground terminals is connected to the corresponding sidewall of the terminal through hole.

* * * * *